US006123151A

United States Patent [19]

Regan et al.

[11] Patent Number: 6,123,151

[45] Date of Patent: Sep. 26, 2000

[54] VALVE FOR USE IN A SUBSEA DRILLING RISER

[75] Inventors: Albert M. Regan, Cypress; Dennis D. George, Spring, both of Tex.

[73] Assignee: Stewart & Stevenson Services, Inc., Houston, Tex.

[21] Appl. No.: 09/193,179

[22] Filed: Nov. 16, 1998

[51] Int. Cl.[7] ..... F21B 17/01

[52] U.S. Cl. ..... 166/367; 166/364

[58] Field of Search ..... 166/358, 363, 166/364, 367; 175/6; 405/224.2

[56] References Cited

U.S. PATENT DOCUMENTS

| | | | |
|---|---|---|---|
| 3,559,734 | 2/1971 | Pitts | 166/224 |
| 3,981,360 | 9/1976 | Marathe | 166/224 |
| 4,621,655 | 11/1986 | Roche | 137/81.2 |
| 4,832,126 | 5/1989 | Roche | 166/358 |
| 5,826,658 | 10/1998 | Harthorn et al. | 166/367 |

FOREIGN PATENT DOCUMENTS 1591319 8/1977 United Kingdom .

WO 96/35857 A1 5/1996 WIPO .

OTHER PUBLICATIONS

"Subsea Riser Systems", Cooper Cameron pages (4) (undated).

"Riser Auto Fill Valve", *1996–7 Composite Catalog,* p. 107, ABR Vetco Advertisement.

Hughes Offshore publication entitled "Automatic Riser Fill Valve—Regan Type FC" (4 pages) dated Nov. 21, 1981.

*Primary Examiner*—Eileen D. Lillis
*Assistant Examiner*—Frederick L. Lagman
*Attorney, Agent, or Firm*—Browning Bushman

[57] ABSTRACT

There are disclosed two types of valves connectible in a subsea drilling riser to permit the opening and closing of side ports therein. One such valve is automatically opened when the hydrostatic subsea pressure is greater by a predetermined amount than that of drilling mud in the riser. The other valve is installed in the lower end of the riser and is adapted to be opened to discharge drilling fluid therefrom.

13 Claims, 8 Drawing Sheets

VALVE FOR USE IN A SUBSEA DRILLING RISER

This invention relates in general to a valve for use in controlling flow between the interior and exterior of a subsea drilling riser having one or more auxiliary lines extending parallel thereto. In one of its aspects, it relates to an improved valve of this type which is adapted to open automatically when the hydrostatic pressure of drilling fluid within the riser drops to a predetermined level below that of seawater outside the riser. In another of its aspects, it relates to an improved valve of this type which may be opened in order to dump drilling fluid in the riser to the subsea environment in response to the supply of hydraulic fluid thereto from a remote source at the surface.

During the drilling of a well, the riser is normally filled with a column of heavy drilling fluid which resists the tendency of the hydrostatic sea pressure to collapse it. However, in the event of loss or drop of the hydrostatic mud pressure, such as, for example, an emergency disconnect, loss of circulation, or following a gas kick, the riser must be promptly filled with seawater to prevent its collapse, especially at the great depths at which such wells are often drilled.

For this reason, a valve is often installed in the riser, normally at rather shallow depth below the water surface, for controlling flow between the interior and exterior of the riser, and thus opening the riser to permit it to fill with seawater, when the mud loss occurs. Preferably, valves of this type are so constructed as to open automatically in response to a predetermined differential pressure between the drilling mud and seawater. These valves, known as automatic fill valves, have a sleeve about a tubular body connected as part of the riser for shifting between positions covering and uncovering a side port in the body. Thus, a pressure chamber formed between the sleeve and riser body has oppositely facing pressure responsive areas on each arranged to shift the sleeve to open position when the predetermined differential occurs.

The other valve of this type, which is known as a mud discharge valve, is normally installed in the lower marine riser package which connects the lower end of the riser to the subsea blowout preventor. During drilling of "top hole", the sleeve about the valve body may be moved to and left in its open position uncovering the side ports in the body as the cuttings are removed by circulation therethrough for discharge on the ocean floor, thus avoiding the hydrostatic head which would be imposed on the formation near the upper end of the well bore. However, this latter type valve does not automatically open, as in the first type, but instead is selectively opened and closed by a remotely controllable operator which responds to hydraulic fluid from a suitable source controlled from the surface.

The aforementioned auxiliary lines, normally choke and kill lines, are non-concentric with the riser itself, and instead extend along its opposite sides. In both types of prior valves, these lines have been bent outwardly at both ends to provide room for the shiftable sleeve and its operating mechanism. Access to seal rings between the sleeve and riser body, or other parts of the operating mechanism, has been difficult, if not impossible, without pulling the lines out of the way, Furthermore, the bends in the lines create corresponding bends in the flow path of the conveyed fluids. Still further, due to apparent concerns with access to make up bolts or welds for this purpose, manufacturers of prior valves have threadedly connected the parts of the riser body.

Although hydraulic operating systems have included overriding features for returning the sleeve of the automatic fill valve to its closed position, and/or moving it to open position in the event it does not do so automatically, they have been of complex construction normally requiring an accumulator.

An object of this invention is to provide valves of this type in which the seals and other operating parts are easily accessible for replacement or repair, and, more particularly, in which the auxiliary lines may be straight.

Another object is to provide such valves in which the risers bodies are of more stress resistance construction and provide direct load paths from end to end.

A further object is to provide an automatic fill valve of this type having an overriding hydraulic operating system of much simpler construction for returning the sleeve to its closed position, or, when required, moving it to open position if so desired.

A still further object to provide such a valve in which the operating system is of such construction as to permit predetermination of the pressure differential required to open the sleeve, and has a means which provides a visual as well an audible remote indication of the position of the sleeve.

These and other objects are accomplished, in accordance with the illustrated embodiments of the invention, by a valve which comprises a body including a tubular member adapted to be connected intermediate upper and lower sections of the riser to form a continuation thereof, and an outwardly enlarged portion intermediate its ends having longitudinal openings through which the adjacent sections of the auxiliary lines may extend. A sleeve surrounds the enlarged portion of the body for shifting between positions opening and closing ports which connect the inner and outer diameter of the enlarged body portion, and seal rings are disposed between the enlarged body portion and the sleeve to close the ports when the sleeve is in closed position. Since the sleeve is outside the auxiliary line, the seals are easily accessible without the need to remove or distort the auxiliary lines. Also, the auxiliary lines are free of bends, and the tubular body provides a direct load path from end to end.

In the embodiment of the invention in which the valve is connected in a lower portion of the riser for use in selectively discharging drilling fluids therefrom, the hydraulic operating system comprises extendible and retractable actuator means which passes through an elongate opening in the enlarged body portion for connection at its ends to the sleeve and the enlarged portion. More particularly, a rod is connected at one end to the sleeve extends through the opening and a cylinder in which the piston reciprocates is mounted adjacent the other end of the opening. Preferably, the end of the rod is releasably connected to the sleeve so that, upon release of the connection, the sleeve may be slid off the enlarged portion to provide access to the seals between the body and sleeve. Thus, the connecting means comprises an annular, inwardly extending flange secured to the sleeve for connection to the end of rod at the end of the elongate opening opposite the cylinder.

In accordance with the illustrated embodiment of the automatic valve, seals between the enlarged body portion and the sleeve form an annular pressure chamber having oppositely facing, substantially equal pressure responsive areas on the sleeve and body, and a means is provided for admitting fluid within the body to the chamber, when the sleeve is in closed position, so that the sleeve is automatically moved to open position when fluid pressure within the body reaches a predetermined level lower than that outside the body. As shown, the fluid admitting means comprises holes in the enlarged body portion connecting one or more of the ports with the pressure chamber.

In accordance with another novel aspect of the invention, additional seals between the enlarged body portion and the sleeve to form another annular pressure chamber having oppositely facing, substantially equal pressure responsive areas on the sleeve and body. More particularly, the oppositely facing pressure responsive areas of both chambers are substantially equal to one another, and the sealing means forming the chambers provide substantially the same frictional resistance, to shifting of the sleeve so that the internal fluid pressure required to open the sleeve may be predicted by observation of the pressure of a test fluid which is admitted to the chamber to move the sleeve toward open position. As shown, the enlarged body portion has an outer annular piston sealably slidable within an outwardly enlarged annular surface of the inner side of the sleeve, so as to separate the chambers, and a port in the sleeve connects the other chamber to with test pressure.

The valve further includes an overriding hydraulic system including first and second actuators each having a cylinder connected to the body, with the piston of the first having a rod which is extended by the sleeve as it moves to open position, but remains extended as the sleeve is moved to closed position, and the piston of the second actuator having a rod which remains retracted as the sleeve is moved to open position. More particularly, the system includes control valves arranged within hydraulic fluid supply and control lines leading to and from the lines as to enable the sleeve to be returned to closed position, following automatic opening, and then moved back to its open position. More particularly, the hydraulic system includes means for sensing a change in fluid pressure responsive to movement of the sleeve and transmitting a signal indicative of the change to a remote location.

In the drawings, wherein like reference characters are used throughout to designate parts:

Figure 6:
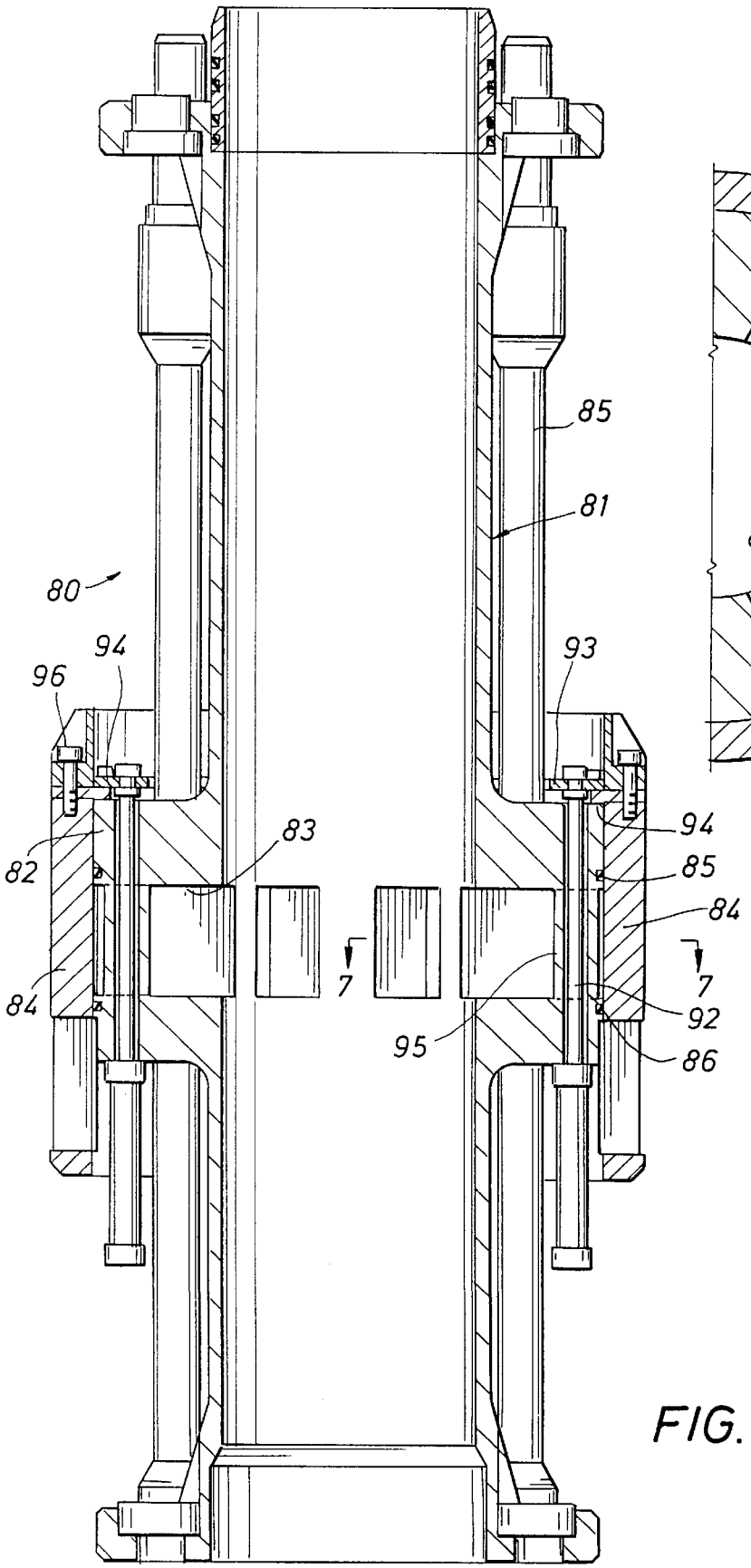
Figure 7:
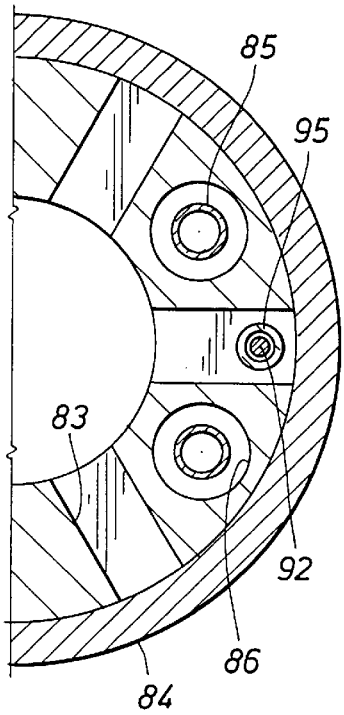

FIGS. 5A, 5B, 5C, and 5D are diagrammatic illustrations of the hydraulic operating system in various positions of their pistons of the first and second actuators;

FIG. 6 is a vertical sectional view of the mud discharge valve, with the valve shown in closed position; and FIG. 7 is a partial cross-sectional view of the valve of FIG. 6, as seen along broke lines 7—7 thereof.

With reference now to details of the above-described drawings, the automatic valve, which is indicated in its entirety by reference character 20, includes a body having a tubular member 21 adapted to be connected at its upper and lower ends to the riser string to form a continuation thereof. These connections can be made in any suitable manner, such as the flanges shown, to form a fluid tight connection between the adjacent ends of the riser string and the valve body.

The tubular member 21 has an outer enlargement 22 intermediate its ends and vertical holes 23 in the enlargement each to receive an adjacent section of auxiliary line 24 extending parallel to the tubular member and mounted to flanges on the ends of the body for support therefrom. As well known in the art, these sections have opposite ends adapted to be connected to adjacent ends of choke and kill lines extending parallel to the riser between the surface and the preventor at the ocean floor. As shown, the tubular member is, in any event, integral from one end to the other, and the holes 23 extend within a recessed area 25 in the upper end of the enlarged body portion to the lower end thereof. A plate 26 is welded across the open upper end of the recessed area and has vertical holes 27 through it aligned with holes 23 to receive the auxiliary lines.

Figure 1A:
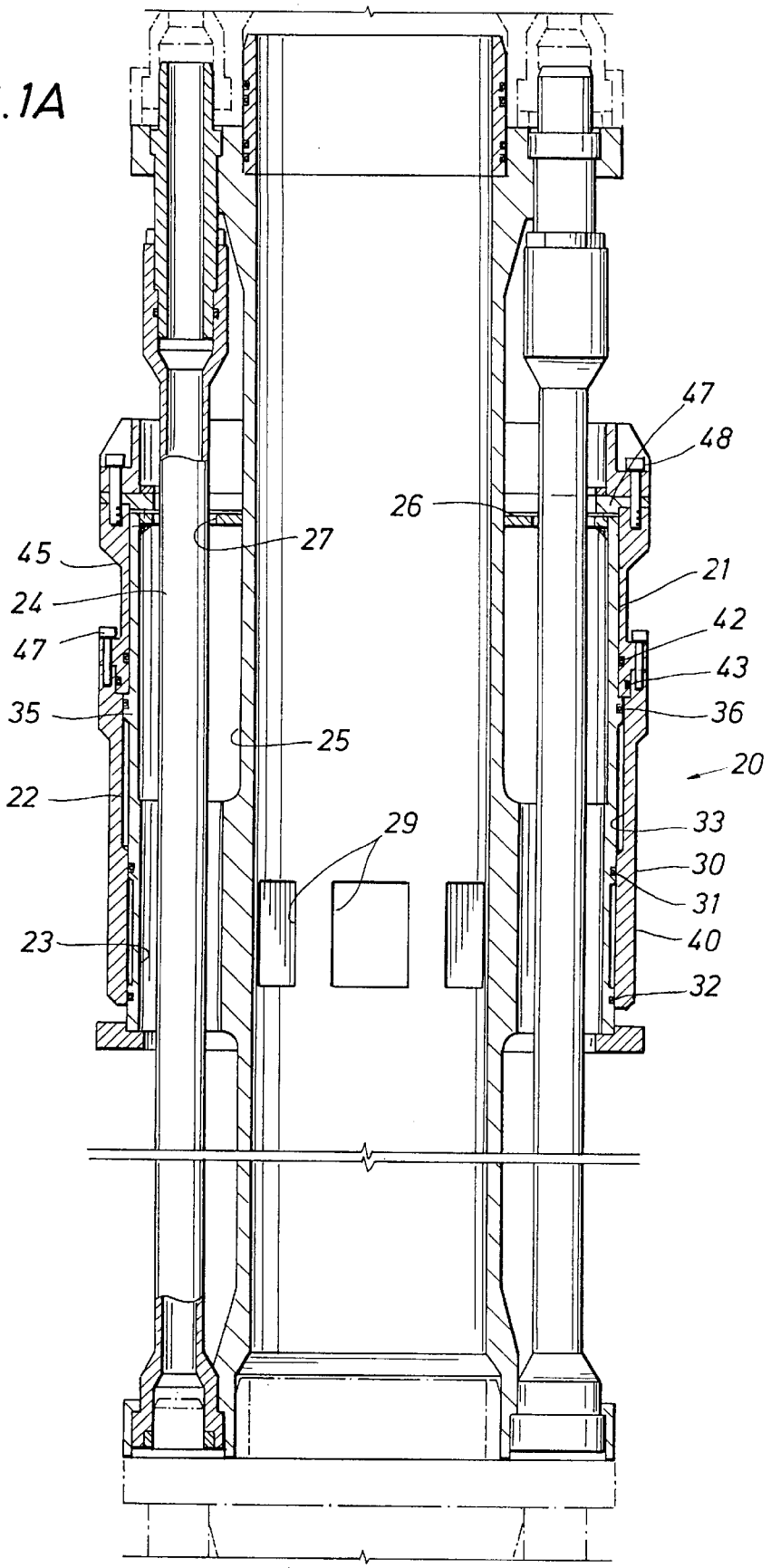
FIG. 1A is a vertical sectional view of the automatic valve, in its closed position and as seen along broken lines 1—1 of FIG. 3.

Circumferentially spaced apart slots 29 are formed through the enlarged body intermediate the holes 23 through which the auxiliary lines extend to connect the inner and outer diameters of the enlarged portion of the body, and thus the bore of the body with the seawater about the valve when the valve is open. A sleeve 30 surrounds the enlarged portion of the body for shifting between an upper position above the slots 29 to open the valve, as shown FIGS. 1B and 2B, and a lower position over the slots to close the valve, as shown in FIGS. 1A and 2A. In its lower position, the sleeve sealably engages seal rings 31 and 32 carried about the outer diameter of the enlarged body portion above and below the slots to prevent the passage of fluid between the inside and outside of the riser.

Figure 4:
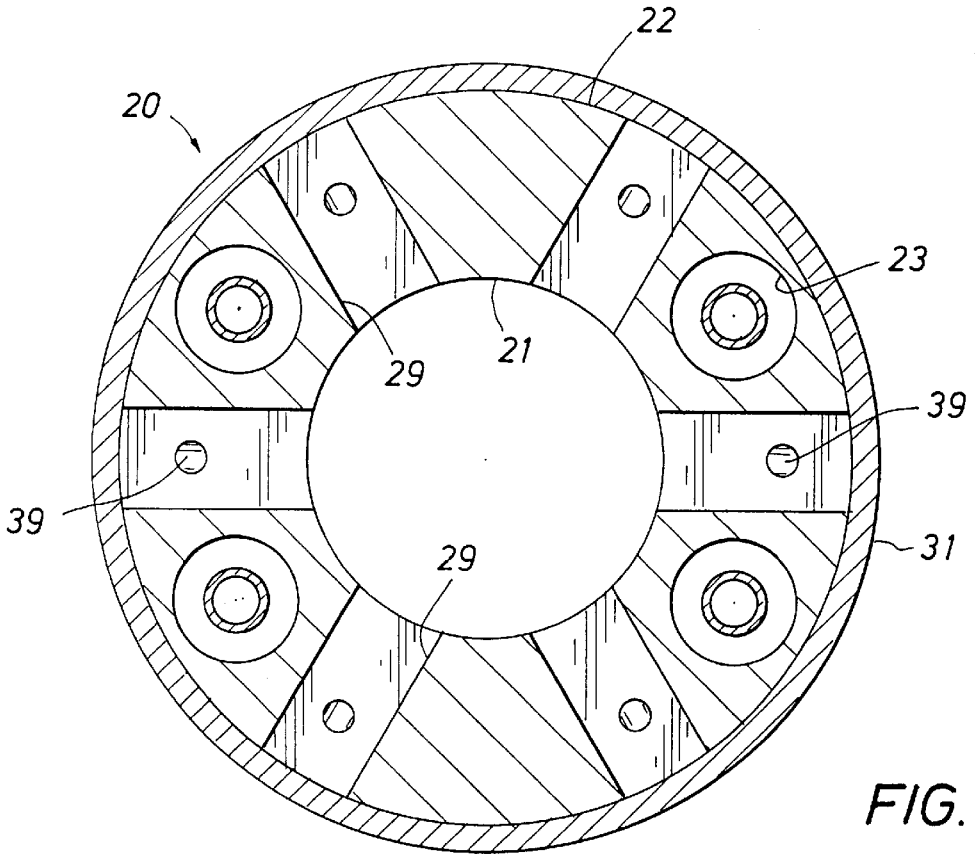
FIG. 4 is another cross-sectional view of the valve as seen along broken lines 4—4 of FIGS. 1A and 2A.

The sleeve has an outwardly enlarged inner diameter portion 33 to form an expandable and contractible pressure chamber between it and the oppositely facing outer diameter of the body intermediate seal ring 31 and a seal ring 36 carried about outwardly extending flange 35 on the body which is slidable within the outwardly enlarged portion of the sleeve above seal ring 31. As best shown in FIGS. 2A and 2B, as well as in FIG. 4, holes 39 are formed in the enlarged body portion to connect with outer diameter of the enlarged portion above the seal ring 31 and thus the pressure chamber.

As previously described, and as will be understood from the drawings, the chamber has a downwardly facing pressure-responsive surface on the flange 35 and an upwardly facing pressure responsive surface on the inner diameter of the sleeve, which face one another and are of the same cross-sectional area. Thus, when the valve is closed, as shown in FIGS. 1A and 2A, fluid pressure within the body enters the chamber through the holes 39 so as to urge the sleeve downwardly to its closed position with a force equal to the cross-sectional area of the chamber times the pressure within the riser, and sea pressure external to the riser acts over a downwardly facing effective area on the lower end of the sleeve to urge it upwardly with an equal force. With the areas having equal size, the frictional resistance at the 0-rings between the sleeve and body will maintain the valve in its closed position as long as the external sea pressure is not greater than the internal pressure by a predetermined amount.

Thus, as long as the riser is full of drilling fluid, which normally is at a hydrostatic pressure greater than that of the hydrostatic sea pressure, the sleeve will remain in its lower position to close the valve. However, in the event of loss of the drilling mud from within the riser, the resulting differential pressure inside and outside of the riser will create an upward force to raise the sleeve and thus open the valve, as shown in FIGS. 2A and 2B, thereby admitting sea water to the riser to prevent the high hydrostatic pressure of the sea water from collapsing it.

The inner diameter of the sleeve above the pressure chamber carries an O-ring 42 for slidably engaging the reduced outer diameter portion of the body above the flange 35 of the sleeve. As shown, this ring is carried on an upper tubular section 45 of the sleeve which is bolted at 47A to the lower tubular section 46 and carries a seal ring 43 to engage the lower section between seal rings 36 and 42. The seal rings 36 and 42 form a second expandable and contractible pressure chamber having a downwardly facing pressure responsive area on the sleeve and an upwardly facing pressure area on the flange 35 of the body of equal area. More particularly, the seal ring 42 is of the same diameter as the seal ring 31 so that the cross-sectional area of the second chamber is equal to and encounters the same frictional resistance to shifting as does the first chamber.

As shown in FIGS. 2A and 2B, one or more ports P are formed in the sleeve to connect the second chamber with the outside of the riser, so that, prior to running of the valve with the riser, test pressure may be supplied to the second chamber to determine and thus predict the pressure differential at which the sleeve would be caused to move from its closed to its open position. When the riser is to be run, the port is of course closed.

Upon release of the bolts 47A, the sleeve sections 45 and 46 may be separated and moved in opposite directions to enable replacement of the seals carried by each. More particularly, in accordance with the primary objects of this invention, this seal replacement may be accomplished without having to distort the auxiliary lines in any way.

Figure 3:
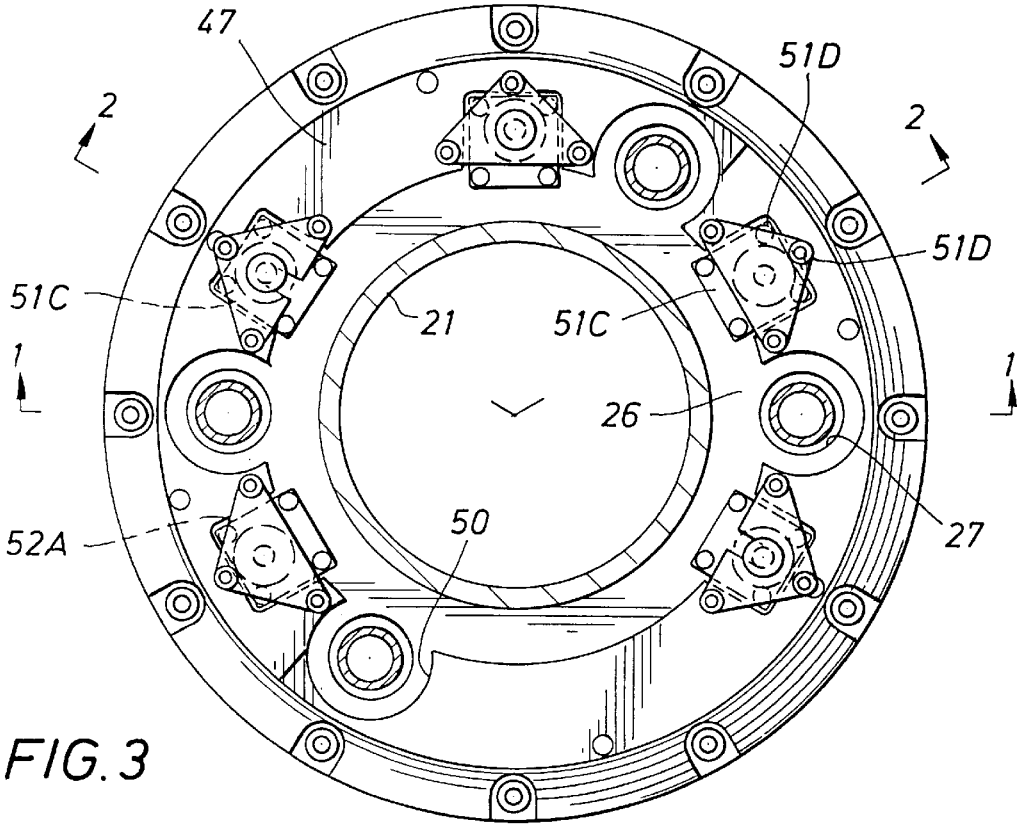
FIG. 3 is a cross-sectional view of the valve and as seen along broken lines 3—3 of FIGS. 1A and 2A.

The sleeve also has a plate 47 mounted on its upper end above the plate 26 on the upper end of the enlarged body portion. More particularly, the plate 47 is split (see FIGS. 3 and 4) and held between the upper end of the upper section 45 and a cap thereof by means of bolts 48. This plate 47A has cut-outs 50 about its inner diameter to receive the auxiliary lines, as best shown in FIG. 3. As will be understood, the split section of the plates provide reaction for the cylinder rods, and may be removed with the cylinders to permit the cylinders to be serviced.

The hydraulic operating system for the valve includes two sets of extendable and retractable actuators 51 and 52 which may be termed "pull" and "push" actuators, respectively. As shown diagrammatically in the hydraulic system drawings of FIGS. 5A to 5D, the upper ends of cylinders 51A and 52A of each of the first and second sets are mounted on support plates 51C bolted to plate 26 at the upper end of the enlarged tubular body within square cut out portions 51D within the inner diameter of plate 47.

The piston rods 51B extending from the cylinders of the first set pass through slots in the triangular plates 51D bolted to plate 47 and have enlarged heads on their upper end passing so as to be in a position to pull the sleeve downwardly. The upper ends of piston rods 52B extending from the cylinders of the second set engage the bottom of plates 51D, to lift the sleeve.

Figure 1B:
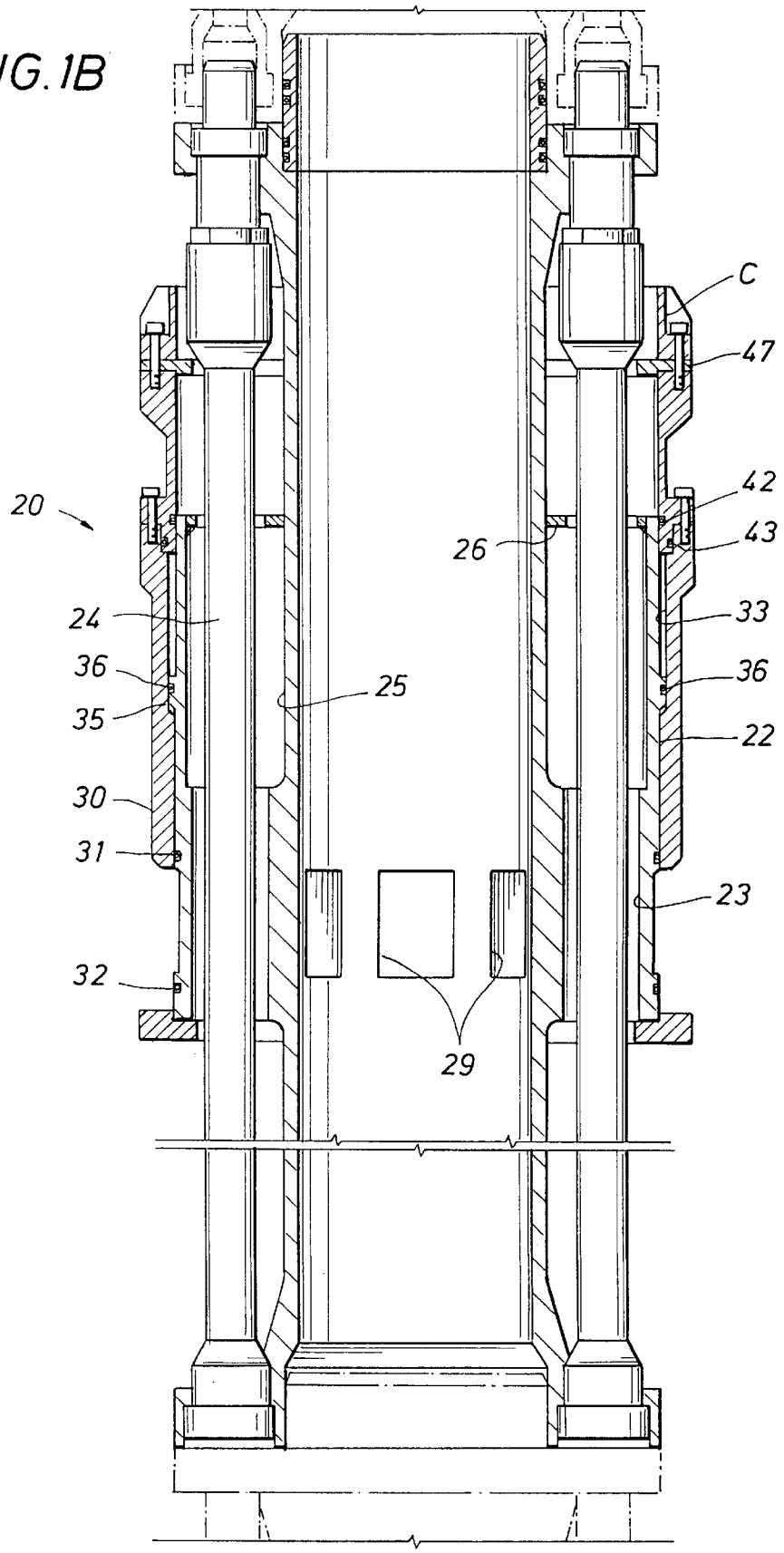
FIG. 1B is a view similar to FIG. 1A, but with the valve moved to its open position.
Figure 2A:
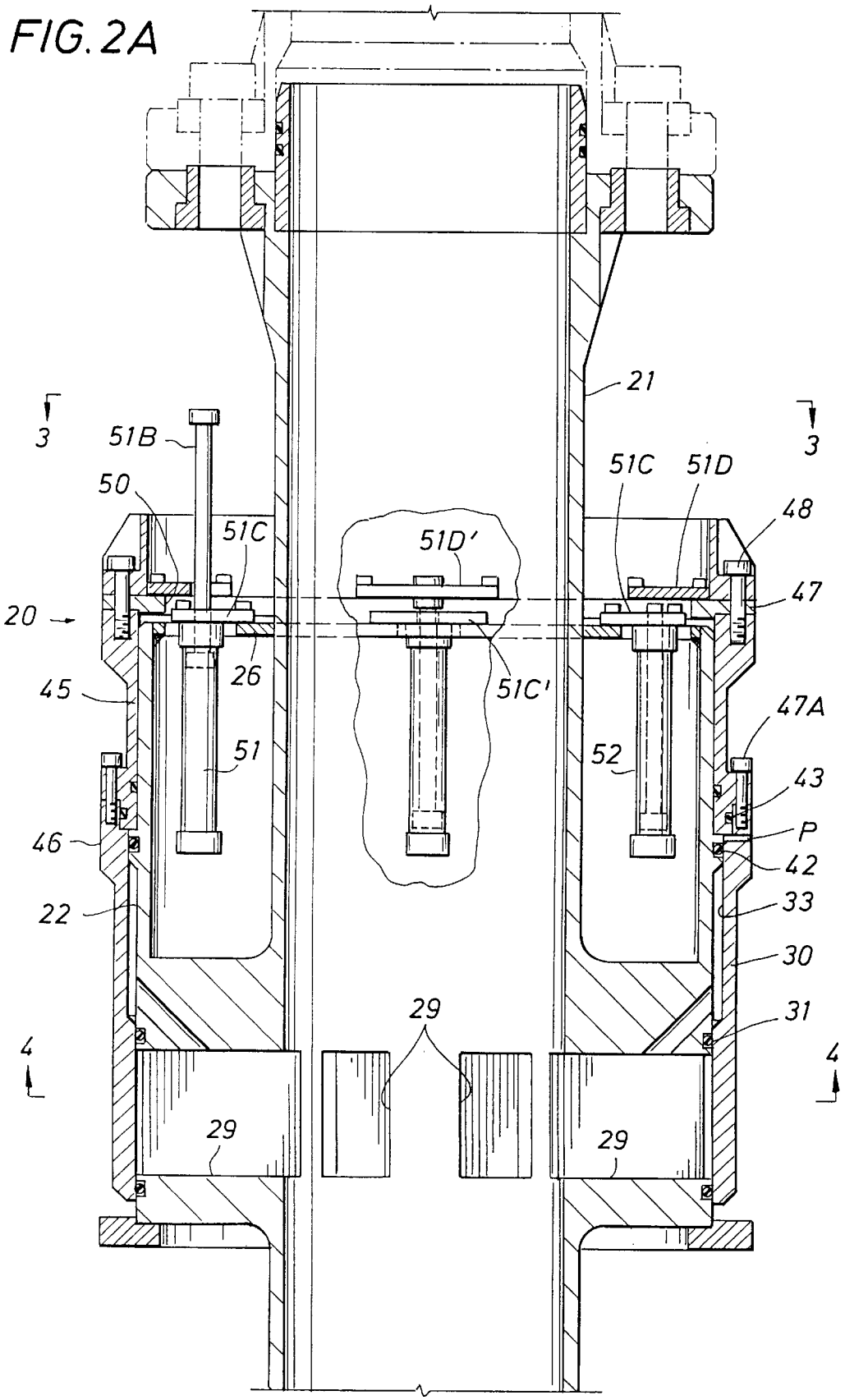
FIG. 2A is another vertical sectional view of the valve, but as seen along broken lines 2—2 of FIG. 3, and with the valve returned to the closed position of FIG. 1A.
Figure 2B:
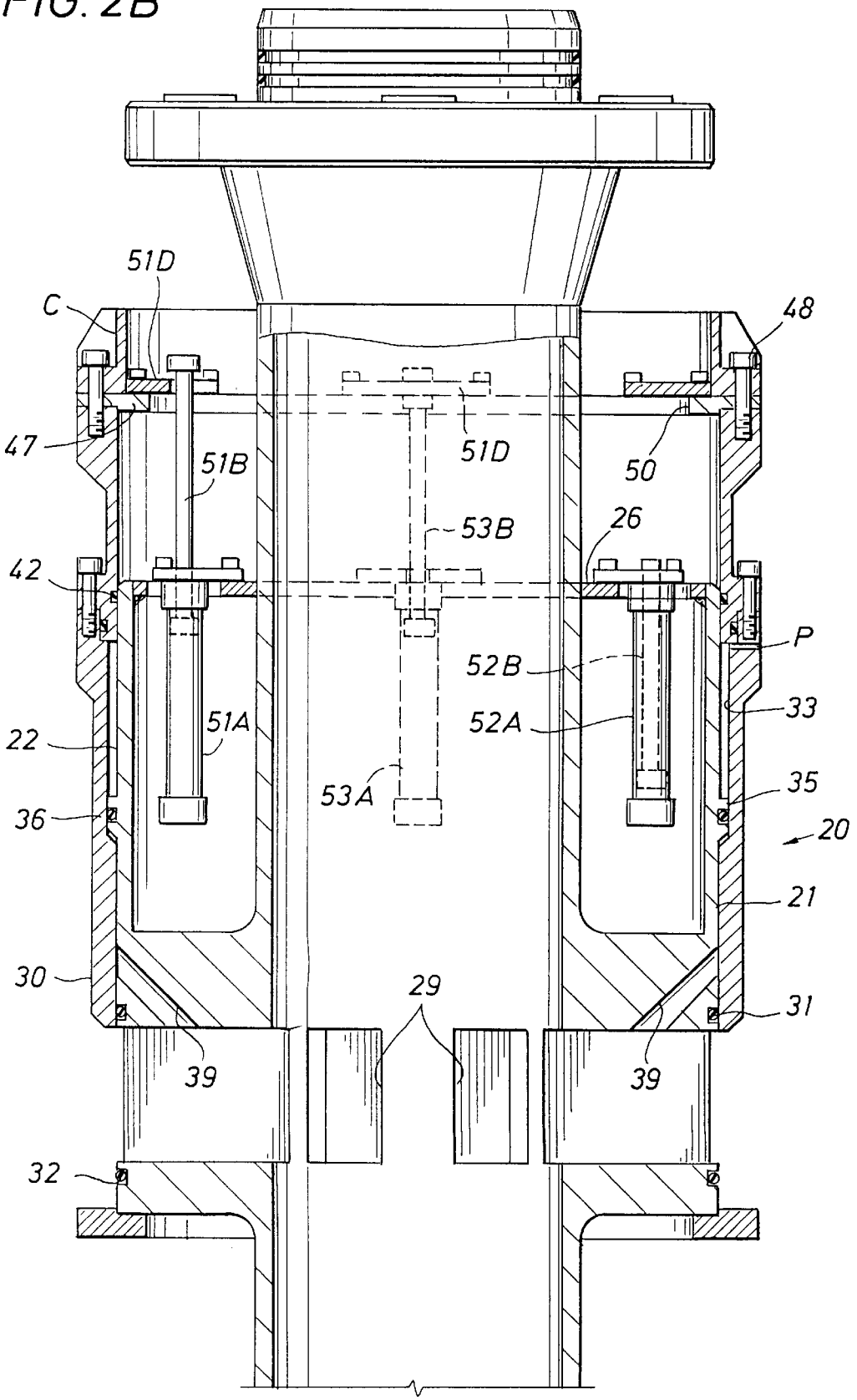
FIG. 2B is still another view of the valve similar to FIG. 2A, but returned to the open position of FIG. 1B.

These actuators thus enable the valve to be returned manually from the open position of FIGS. 1A and 1B to the closed position of FIGS. 1A and 2A, and from the closed position to the open position of FIG. 2B, thereby enabling the automatic system to be manually overridden by pressure fluid from a remote source.

For this purpose, control valves $V_1$ and $V_2$ are connected in control lines 60 and 61, respectively, leading from and returning to a source of control fluid which may be at the surface or other remote location. When the valves $V_1$ and $V_2$ are in the positions of FIG. 5A and FIG. 5B, the line 60 is connected with the lower ends of the cylinders 51A of the first set of actuators beneath the piston thereof and the upper ends of the cylinders 52A of the second set above the pistons on the rods. At the same time, the lower ends of the cylinders 51A of the first set and lower ends of the cylinders 52A of the second set above the pistons rods are connected to branch exhaust line 61B. Thus, with the valves in this position, the sleeve is free to move up with plate 47 to the open position in response to the loss of drilling mud, without moving the manual override cylinders. This is accomplished without the need for an accumulator as was common in the prior art for this purpose.

In order to override the automatic side of the system and manually return the sleeve to its lower closed position, the valve $V_1$ is shifted to its alternate position of FIG. 6A, as the valve $V_2$ is shifted to its second position shown in the same figure. Thus, as control fluid is admitted to the upper ends of the cylinders 51A, and pressure fluid in the lower ends of the cylinders is exhausted to the return line 61, the sleeve is pulled down to its lower position to close the valve.

Figure 5A:
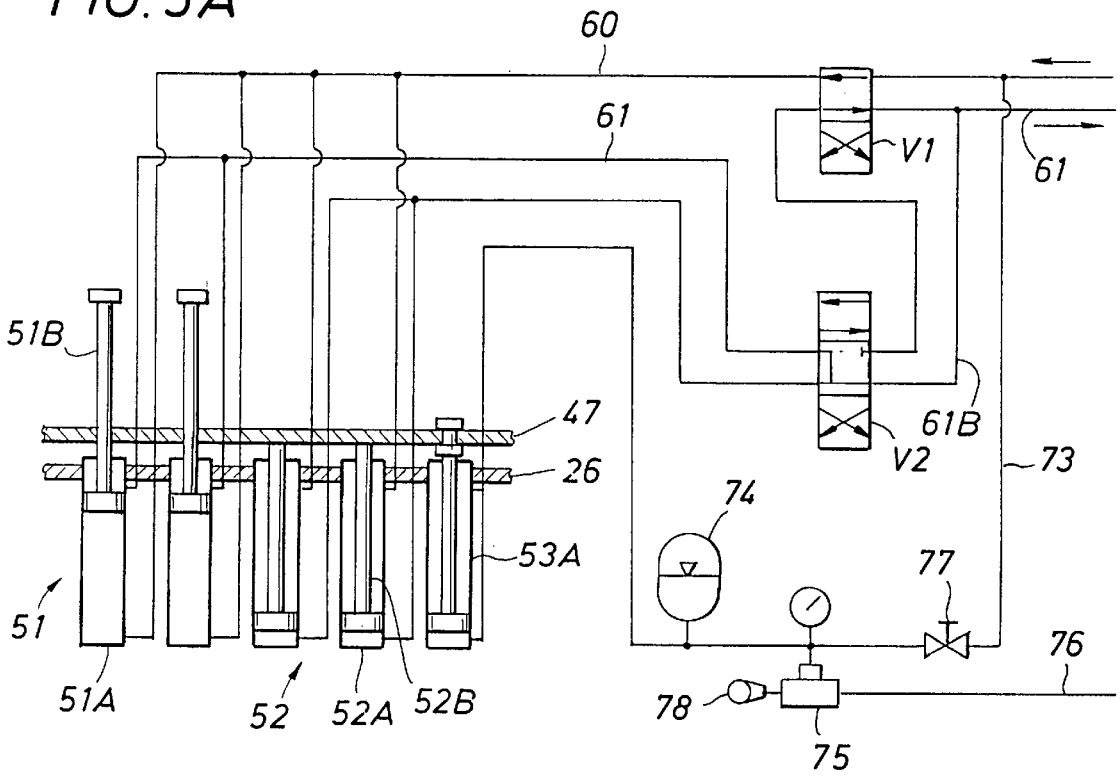
Figure 5B:
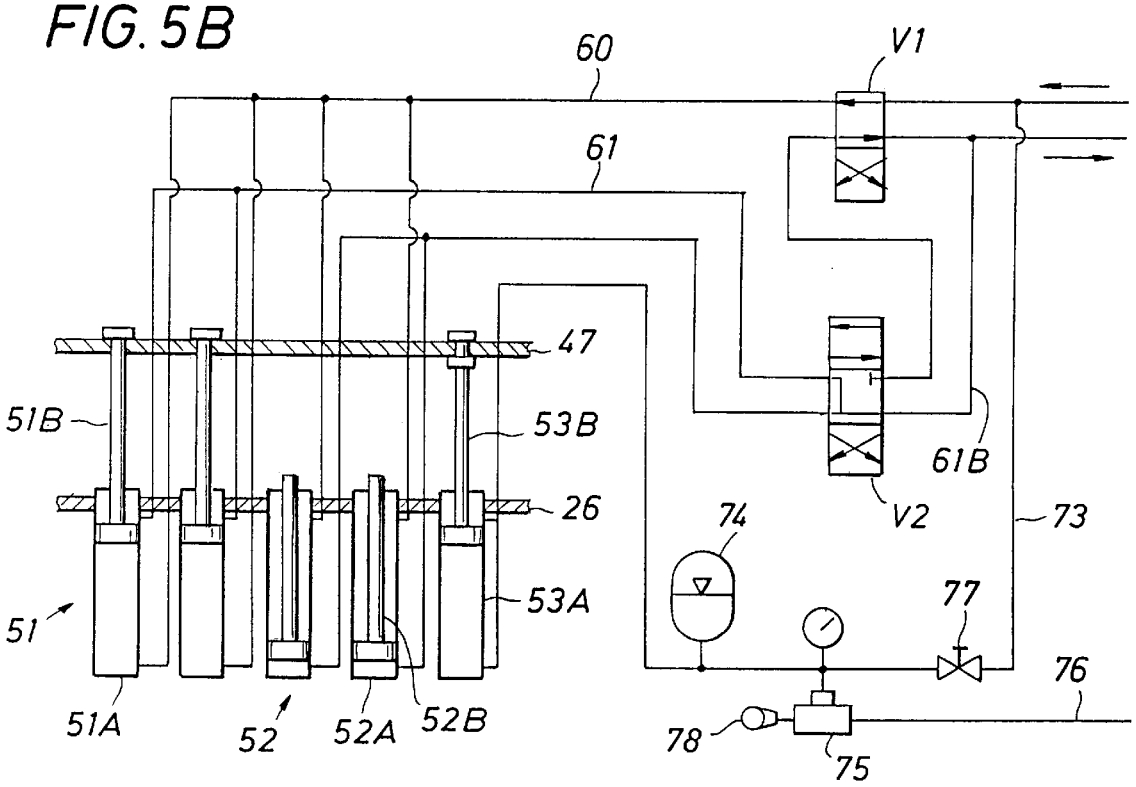
Figure 5C:
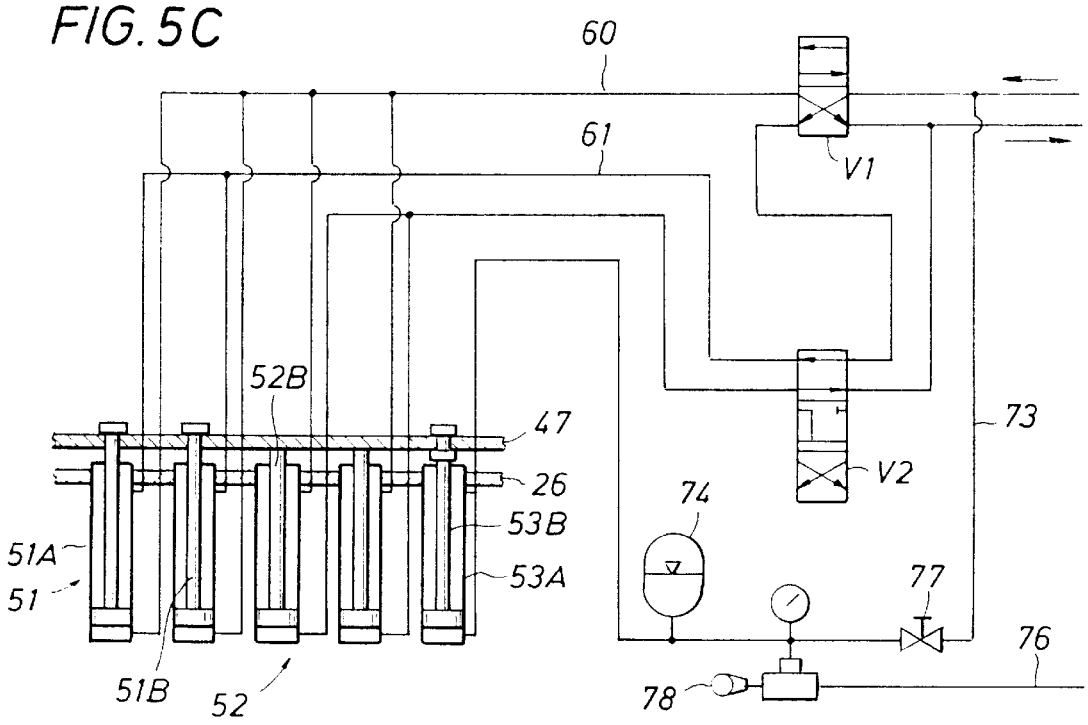
Figure 5D:
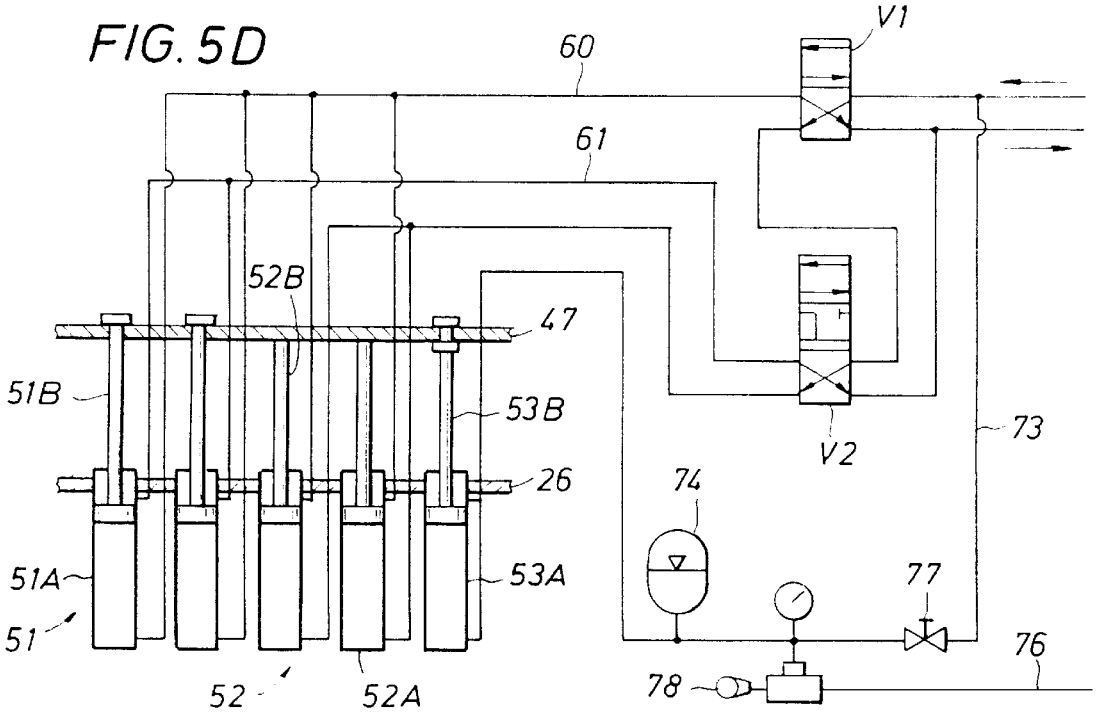

In order to manually reopen the valve, the valve $V_2$ is shifted to its third position shown in FIG. 5B thus causing the external source of pressure fluid to be directed to the lower ends of the cylinders 52A of the second set for raising their pistons and "pushing" the plate 47 of the sleeve upwardly. The pistons or rods 51B of the first set of actuators do not resist this upward movement of the upper sleeve since pressure fluid in its upper ends of the cylinders 51B is exhausted through the valve $V_2$ to a bypass line 61B leading to the return.

As previously described, there is a fifth cylinder 53A and piston rod 53B connected between plate 47 and flange 26 and thus slave to the sleeve 30 to provide an external indication of the position of the sleeve. For this purpose, the cylinder 53A is mounted on a plate 51C on flange 26 of the body, and the upper end of rod 53B is connected to flange 47 of the sleeve 30 so as to move upwardly and downwardly with the sleeve. Consequently, when the piston rod is raised with the sleeve, it indicates that the valve is open, while lowering of the rod with the sleeve indicates that the valve is closed.

A third line 73 is connected between the control line 60 and branches connecting with the cylinder 53A above and below the piston thereof. As shown, an accumulator 74 is mounted in the line to receive pressure fluid from the line 73, and a pressure switch 75 controls an air supply line 76 to an audio and electrical alarm 78. In addition, there is a valve 77 in the line 73 upstream of the pressure gage, so that the line may be closed after supplying the accumulator with control fluid. In this manner, the pressure of the captured control fluid connecting with the cylinder of the actuator above and below the piston thereof is sensitive to the movement of the piston to its upper or its lower positions. That is, when the piston is raised as the sleeve moves to its opened position, the pressure is decreased, and conversely, when the piston is lowered in response to lowering of the sleeve to its closed position, the pressure is increased. These pressure changes may be sensed by the pressure switch, which in turn activates the audible and electrical alarm at the remote location for convenient reading.

The manually controllable mud discharge valve, indicated in its entirety by reference character 80 in FIG. 6, comprises, as in the case of the automatic valve, a body having a tubular member 81 connectible at its upper and lower ends in a riser to form a continuation thereof, and an outwardly enlarged portion 82 intermediate its ends. As is also the case in the automatic valve, the intermediate body portion of the valve has slots 83 formed in circumferentially spaced relation through to connect its inner and outer diameters, and a sleeve 84 is disposed about the enlarged portion for shifting between a lower position across the outer ends 83 to close the valve, as shown in FIG. 6, and an upper position in which ports in the sleeve are aligned with ports 83 to open the valve. As in the case of the automatic valve, sections of auxiliary lines 85 extending parallel to the riser, circumferentially spaced outside of the riser but within the sleeve 84, extend through holes or passageways 86 in the enlarged body portion, as shown in FIG. 7, to connect to upper and lower ends of the lines. Upper and lower seal rings 85 and 86 are carried about the outer diameter of the enlarged body portion above and below the ports 83 therein, for slidable engagement by the sleeve 84 as it moves between its open and closed positions.

The sleeve is moved between open and closed positions by means of actuators 92 extending between the enlarged body portion and a plate 93 mounted on the sleeve above the enlarged body portion. Thus, as in the case of the automatic embodiment of the valve, the cylinder of each actuator is mounted on the lower side of the enlarged body portion, and the plate 93 is bolted to an inwardly extending flange 94 on the sleeve which rests on the upper end of the enlarged portion of the body. The rod extends through holes in the enlarged body portion including a sleeve 95 bridging a slot 83.

The upper end of the rod extends through a hole in the plate and is in turn clamped with the piston in its lower position, as shown in broken lines in FIG. 6. The supply of hydraulic control fluid to the lower end of the cylinder extends the rods of the actuators to raise the sleeve to its open position, while retraction of the rods will return the sleeve to the closed position of FIG. 6. Appropriate connections may be made to the cylinder above and below the piston to permit the hydraulic fluid from a remote source to be supplied or exhausted therefrom.

From the foregoing it will be seen that this invention is one well adapted to attain all of the ends and objects herein above set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A valve for use in controlling flow between the interior and exterior of a subsea drilling riser having one or more auxiliary lines extending parallel thereto, comprising a body including a tubular member adapted to be connected intermediate upper and lower sections of the riser to form a continuation thereof, and having an outwardly enlarged portion intermediate its ends with longitudinal openings through which the sections of the auxiliary lines adjacent to the tubular member may extend, and ports connecting the inner and outer diameters of the enlarged portion, a sleeve surrounding the enlarged portion for shifting between positions opening and closing the outer ends of the ports, means sealing between the enlarged body portion and the sleeve to prevent flow through the ports in the closed position of the sleeve, and means for moving the sleeve between said opened and closed positions.

2. As in claim 1, wherein the moving means comprises extendible and retractable actuator means extending through the enlarged portion the opposite ends of the actuator means connected to the sleeve and the enlarged portion.

3. As in claim 2, wherein the actuator means includes a rod connected to the sleeve and extending through an opening in the enlarged body portion and a cylinder in which the piston reciprocates mounted adjacent the end of the opening.

4. As in claim 3, wherein the end of the rod is releasably connected to the sleeve so that, upon release of the connection, the sleeve may be slid off the enlarged portion to provide access to the sealing means.

5. As in claim 3, including an annular, inwardly extending flange secured to the sleeve for connection to the end of rod at the other end of the opening.

6. A valve for use in controlling flow between the interior and exterior of a subsea drilling riser having one or more auxiliary lines extending parallel thereto, comprising a body including a tubular member adapted to be connected intermediate upper and lower sections of the riser to form a continuation thereof, and having an outwardly enlarged portion intermediate its ends with longitudinal openings through which the sections of the auxiliary lines adjacent the tubular member may extend, and ports connecting the inner and outer diameters of the enlarged portion, a sleeve surrounding the enlarged portion for shifting between positions opening and closing the outer ends of the ports, means sealing between the enlarged body portion and the sleeve to form an annular pressure chamber having oppositely facing, substantially equal pressure responsive areas on the sleeve and body, and means for admitting fluid within the body to the chamber, when the sleeve is in closed position, so that the sleeve is moved to open position when fluid pressure within the body reaches a predetermined lower level than that outside the body.

7. As in claim 6, wherein the fluid admitting means comprises passageway means connecting one or more of the ports with the pressure chamber.

8. As in claim 7, including additional means sealing between the enlarged body portion and the sleeve to form another annular pressure chamber having oppositely facing, substantially equal pressure responsive one on the sleeve and body, and means by which test pressure may be admitted to said other pressure chamber to move said sleeve from the closed to the open position, the oppositely facing pressure responsive areas of both chambers being substantially equal to one another, and the sealing means forming the chambers providing substantially the same frictional resistance, so pressure required to open the sleeve can be predicted.

9. As in claim 8, wherein the enlarged body portion has an outer annular piston sealably slidable within an outwardly enlarged annular surface of the inner side of the sleeve so as to separate the chambers.

10. As in claim 9, including a port in the sleeve leading to the other chamber and through which test pressure may be admitted to the other chamber.

11. As in claim 6, including a piston connected to one and a cylinder connected to the other of the sleeve and enlarged body portion so that their relative positions provide a visual indication of the position of the sleeve.

12. As in claim 11, including means for sensing a change in fluid pressure on one side of the piston responsive to movement of the sleeve and transmitting a signal indicative of the charge to a remote location.

13. As in claim 6, including a hydraulic control system comprising first and second actuators each including a cylinder mounted on the body, one actuator having a piston positioned to push the sleeve in one direction, and the other actuator having a piston rod positioned to pull the sleeve in the other direction, supply and return lines for supplying control fluid from and returning control fluid to a source of same, and control valves for selectively connecting and disconnecting the lines with the cylinders in such a manner as to move the rod of the one actuator to a position to permit the sleeve to automatically move to its open position, and move the rod of the second actuator to a position to return the sleeve to closed position, whereby the sleeve may again be moved automatically to open position.

* * * * *